US005193358A

United States Patent [19]

Winther

[11] Patent Number: 5,193,358

[45] Date of Patent: Mar. 16, 1993

[54] COMPRESSION COOLING PLANT PROVIDED WITH AN OIL SEPARATOR

[76] Inventor: Aage B. Winther, Quinta "Gi-Gi" cruce 9a transversal con 6a avenida, Altamira Norte, Caracas, Venezuela

[21] Appl. No.: 768,589

[22] PCT Filed: Jul. 19, 1989

[86] PCT No.: PCT/DK89/00179

§ 371 Date: Sep. 30, 1991

§ 102(e) Date: Sep. 30, 1991

[87] PCT Pub. No.: WO90/12263

PCT Pub. Date: Oct. 18, 1990

[30] Foreign Application Priority Data

Mar. 30, 1989 [DK] Denmark ..... 156389

[51] Int. Cl.[5] ..... F25B 43/02

[52] U.S. Cl. ..... 62/470; 62/84

[58] Field of Search ..... 62/470, 473, 84, 513

[56] References Cited

U.S. PATENT DOCUMENTS

| | | | |
|---|---|---|---|
| 1,500,280 | 7/1924 | Shipley | 62/470 |
| 2,230,892 | 2/1941 | Miller | 62/470 |
| 2,285,130 | 6/1942 | Phillips | 62/470 |
| 2,867,098 | 1/1959 | Kocher | 62/473 |
| 3,721,108 | 3/1973 | Kocher | 62/470 |
| 3,724,231 | 4/1973 | Grant | 62/470 |
| 3,751,936 | 8/1973 | Simard | 62/470 |
| 3,850,009 | 11/1974 | Villadsen | 62/470 |
| 4,329,855 | 5/1982 | Larsson | 62/473 |
| 4,558,573 | 12/1985 | La Monica | 62/473 |
| 5,072,593 | 12/1991 | Van Steenburgh, Jr. | 62/470 |

FOREIGN PATENT DOCUMENTS

| | | |
|---|---|---|
| 148567 | 7/1985 | Denmark . |
| 016509 | 3/1980 | European Pat. Off. . |
| 658370 | 4/1979 | U.S.S.R. . |
| 841464 | 12/1987 | U.S.S.R. . |

*Primary Examiner*—Ronald C. Capossela

*Attorney, Agent, or Firm*—Antonelli, Terry, Stout & Kraus

[57] ABSTRACT

A compression refrigerating system includes an oil and air separator spaced between the refrigerant receiver and the evaporators of the system, and the refrigerant of the mixture of oil and refrigerant contributes to the cooling of the refrigerant circulating to the evaporators by the evaporation in the oil separator.

18 Claims, 4 Drawing Sheets

COMPRESSION COOLING PLANT PROVIDED WITH AN OIL SEPARATOR

BACKGROUND OF THE INVENTION

The invention relates to a compression refrigerating system. Refrigeration systems supply lubricating oil to the compressor which a small amount of the oil is carried through the system by the circulating refrigerant. Since the lubricant is continuously supplied to the compressor, a considerable amount of oil may be deposited in the refrigerant, resulting in a reduced cooling capacity of the refrigerant. Therefore, to maintain a system which is economical to operate and to maintain, an effective separation of oil and undesired materials from the refrigerant is desirable.

U.S. Pat. No. 3,850,009 describes a compression refrigerating system having an oil separator which separates the oil from the gaseous refrigerant in two steps. This has proved to be less efficient than separating the oil from the liquid refrigerant.

U.S. Pat. No. 2,285,123 describes a refrigerating system in which the liquid refrigerant passes through heat exchangers which is complicated by thermostat valves controlling the temperature of the mixture of oil and refrigerant such that the oil is separated easily.

European Patent Specification No. 0016509 describes an apparatus for separation of oil from a refrigerant in the gaseous phase. The oil separator is mounted in the refrigerating system between the pressure side of the compressor and the condenser.

DK Printed Specification No. 148546B describes a freezing or refrigerating system with an oil separator, having the separator spaced under a evaporator and having a complicated construction such that the separator only services a part of the refrigerating system.

SUMMARY OF THE INVENTION

It is an object of the present invention to provide a refrigerating system for purifying the refrigerant economically while the refrigerant is in the liquid state and during the normal operation of the system.

The refrigerating system simply achieves oil separation and can be fitted into the refrigerating system. The temperature drop occurring in the heat exchanger vessel of the oil separator and resulting from the evaporation of the refrigerant of the oil and refrigerant mixture during the oil separation, cools the liquid refrigerant which flows to the evaporators of the system through the primary heat exchanger.

An advantageous embodiment of the refrigerating plant according to the invention is that the separation occurs in several steps; the first step occurs in a primary vessel having liquid refrigerant conducted to the primary vessel by a supply pipe connected to an outlet of the condenser, and a discharge pipe connects the primary vessel to the refrigerant receiver; and an oil discharge pipe having an inserted shut-off valve is connected to the oil sump pipe; the last step of the oil separation occurs in the vessel of the heat exchanger. Hereby, an almost complete separation of the lubricating oil supplied to the compressor may be obtained.

A further embodiment of the present invention of the refrigerating plant is that the vessel of the heat exchanger of the oil separator is divided into two parts, each part being separated by a heat transmitting wall. The first part, which includes the primary heat exchanger, functions as the oil separator while the other part, which functions as an air and non-condensable gas separator, includes a secondary heat exchanger; one side of the other part is connected to the primary heat exchanger such that the liquid refrigerant exiting from the primary heat exchanger passes through the secondary heat exchanger before the liquid refrigerant enters the evaporators of the system. The other side of the other part is connected to the oil sump of the refrigerant receiver, and the one side is connected to the first part of the vessel of the heat exchanger such that the liquid mixture of oil and refrigerant passes from the oil sump through the secondary heat exchanger to the first part of the heat exchanger vessel. The second part of the heat exchanger vessel has a supply pipe and a return pipe to the refrigerant receiver as well as an air discharge pipe discharging into the atmosphere. This embodiment of the refrigerating system according to the invention is specially advantageous for systems in which the refrigerant is frequently filled up or exchanged, since the cooling of the hot mixture of refrigerant at 20°-30° C., the air in the vessel and the noncondensable gas by the cold refrigerant at about −10° C., which is separated from the mixture of oil and refrigerant by the heat transmitting wall, results in a quick separation of air and noncondensable gas and results in an system which is economical. Moreover, the transport of the mixture of oil and refrigerant through the secondary heat exchanger results in the mixture being introduced into the oil separator part; here the mixture undergoes through a comparatively large free fall which, because of the difference in specific gravity between the oil and the refrigerant, contributes to a quick and effective separation of the mixture.

A further embodiment of the refrigerating system according to the present invention is that the separation may occur in several steps as with the previous mentioned embodiment and that the heat exchanger vessel of the separator is divided in two parts including the first part functioning as the oil separator and the second part functioning as the separator for air and noncondensable gas as in the previously mentioned embodiment. Therefore, both the above mentioned advantages, an enhanced oil separation and a quick and efficient separation of air and noncondensable gas, is obtained. Further embodiments, all concern appropriate details of the construction of the refrigerating plant according to the invention.

BRIEF DESCRIPTION OF THE DRAWINGS

The invention will be further explained in the following with reference to the drawings, in which.

DETAILED DESCRIPTION

Figure 1:
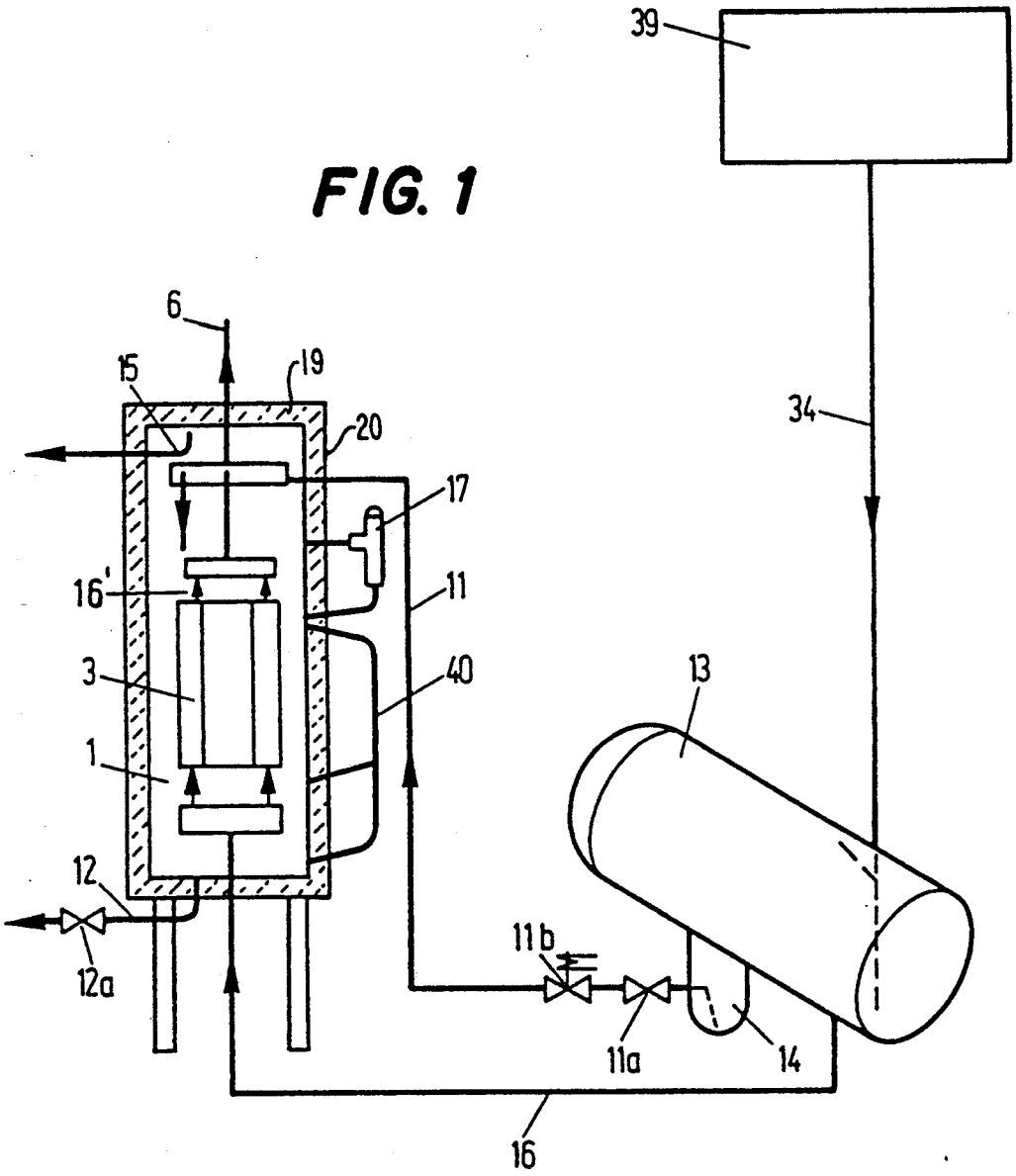
FIG. 1 shows schematically an embodiment of the refrigerating plant according to the invention with an oil separator with one step.

FIG. 1 shows schematically a part of the refrigerating plant according to the invention with the connections between the condenser, the refrigerant receiver 13 and the oil separator 1 and a vertical section through the latter. From this the oil separator is constructed as a vessel 1, which is provided with a layer of heat insulating material 19, which is in turn enclosed in a metallic outer lining 20. The vessel 1 includes a primary heat exchanger 3, which includes tubes through which liquid refrigerant flows from the refrigerant receiver 13 by a primary pipe 16 and continues to flow through a secondary pipe 16' to the supply pipe 6 for the evaporators of the system.

The refrigerant receiver 13 includes an oil sump 14 spaced in the bottom portion; the oil sump 14 collects the oil containing portion of the refrigerant, and the refrigerant is conducted to the upper part of the oil separator 1 through an oil sump pipe 11 having a shut-off valve 11*a* and a magnet valve 11*b*. As the oil and refrigerant free falls through the vessel, the oil and the refrigerant is separated, and the oil is collected at the bottom of the vessel and discharged through an oil discharge pipe 12 with a discharge valve 12*a*. The refrigerant in the mixture evaporates, dropping the temperature in the vessel to about −10° C. This temperature drop cools the refrigerant flowing towards the evaporators through the primary heat exchanger 3. The refrigerant evaporated from the mixture is conducted from the vessel 1 to the suction side of the compressor through a suction pipe 15 and is returned to the refrigerating system.

The vessel is provided with an electric level regulator 17 for the control of the level of the mixture of oil and refrigerant in the vessel 1 of the oil separator. The electric level regulator 17 controls a magnet valve 11*b* in the oil sump pipe 11 by a relay such that a predetermined amount of oil an refrigerant according to the circumstances is supplied to the vessel 1 of the oil separator.

Figure 2:
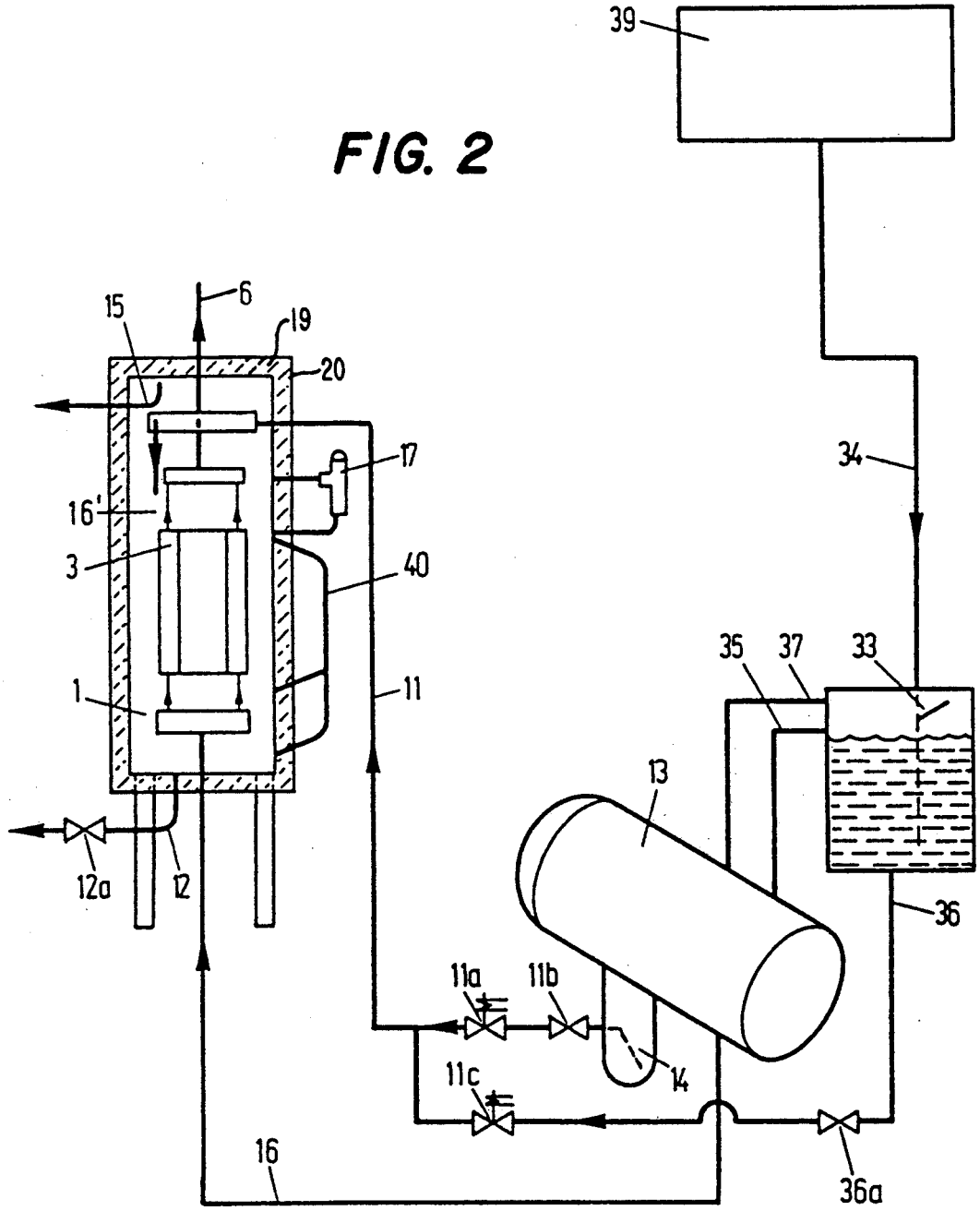
FIG. 2 shows schematically a second embodiment of the refrigerating plant according to the invention with an oil separator with several steps.

In the refrigerating system shown schematically in FIG. 2 and in accordance with the present invention, the oil separator is constructed such that the separation takes place in two steps. The first step occurs in a primary vessel 33, which is connected to a supply line 34 which is connected to the outlet of the condenser 39 for conducting liquid refrigerant, and a discharge line 35 is connected to the refrigerant receiver 13. The supply line 34 is connected to the primary vessel at a point at a first predetermined height above the bottom of the primary vessel 33, while the discharge line 35 is connected to the primary vessel at a second predetermined height, for example, at the upper third of the primary vessel. This height is sufficiently high for the oil and the refrigerant to separate in layers by gravitation and is sufficiently high to prevent the separated refrigerant with a lesser content of oil from flowing over the layers and being conducted to the bottom of the refrigerant receiver 13.

The oil collected at the bottom of the primary vessel 33 is conducted to the oil sump pipe 11 through a primary oil discharge line 36 through the shut-off valve 36*a* and a magnet valve 11*c* to the oil sump pipe 11, such that the second step of the oil separation occurs in the heat exchanger vessel 1 in the same way as in the embodiment of the refrigerating plant according to the present invention shown in FIG. 1. The level of the mixture of oil and refrigerant in the heat exchanger vessel 1 is maintained by the electric level regulator 17. A time clock controls two magnet valves 11*b*, 11*c* in the primary oil discharge line 36 and the oil sump pipe 11, respectively, to adjust the discharge of the mixture from the refrigerant receiver 13 and from the primary vessel 33.

Figure 3:
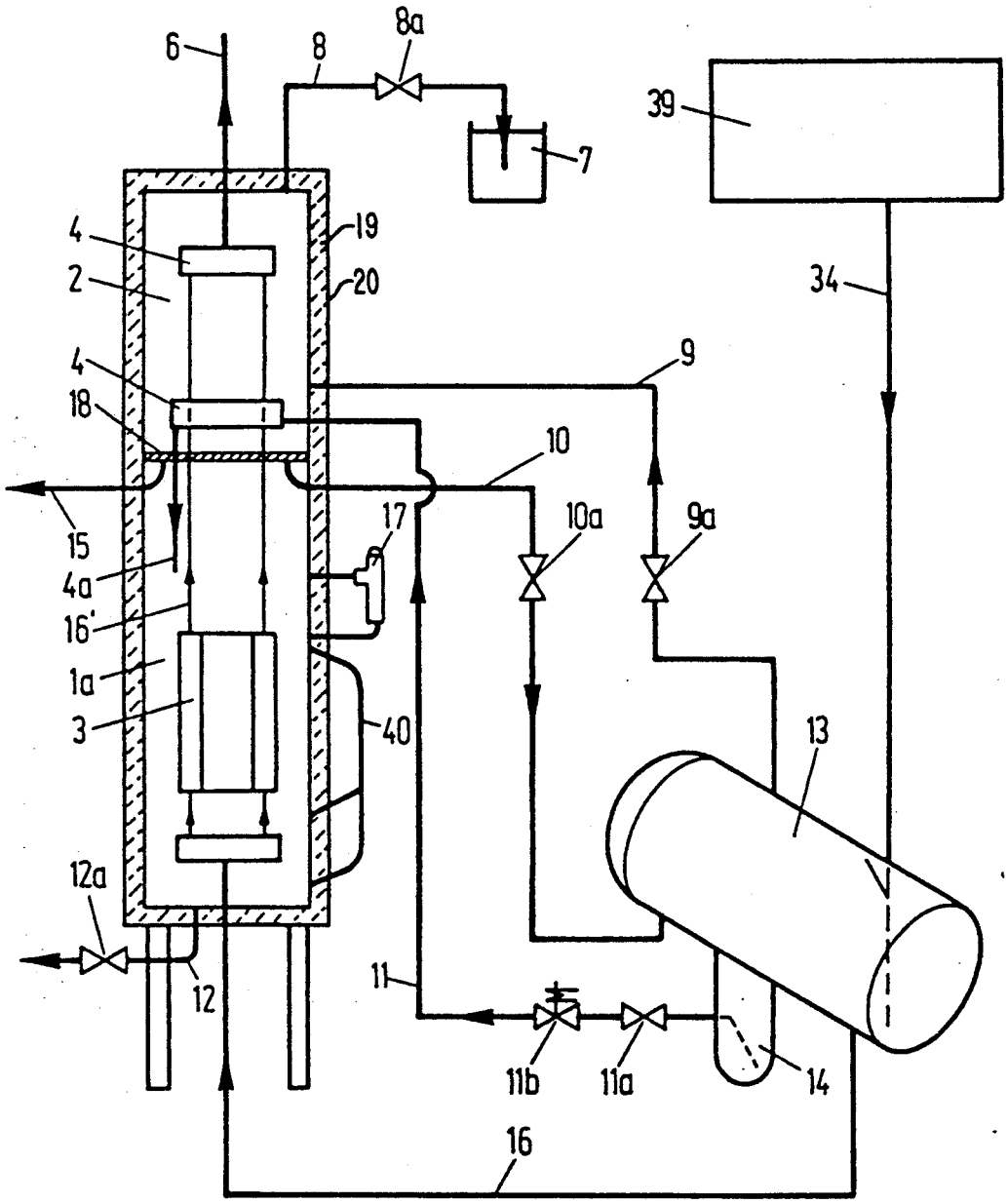
FIG. 3 shows schematically a third embodiment of the refrigerating system according to the invention with a combined oil and air separator.

FIG. 3 shows schematically an embodiment of the refrigerating system according to the invention in which the heat exchanger vessel of the oil separator is divided in two separate vessel parts 1*a*, 2 by a heat transmitting wall 18. The first part la of the oil separator, which includes the primary heat exchanger 3, functions as an oil separator, while the second part 2 functions as separator for air and noncondensable gas; the second part 2 includes a secondary heat exchanger 4, which is connected to the primary heat exchanger 3 through the secondary and primary pipe 16', 16. The primary heat exchanger 3 is connected to the refrigerant receiver 13 through the primary pipe 16 such that the liquid refrigerant passes from the refrigerant receiver 13 through the primary heat exchanger 3 and through the secondary heat exchanger 4 to the supply pipe 6 of the evaporators of the system. The other side of the secondary heat exchanger 4 is connected to the oil sump 14 of the refrigerant receiver through the oil sump pipe 11 and is connected to the first part of the heat exchanger vessel 1*a* through a downpipe 4*a* such that the liquid mixture of oil and refrigerant passes from the oil sump 14 through the secondary heat exchanger 4 and through the downpipe 4*a* by free fall to the first part of the heat exchanger vessel. This aspect of the present invention otherwise functions in the same way as the oil separator shown in FIG. 1.

The lower part of the second part 2 of the heat exchanger vessel 2 is connected to the upper part of the refrigerant receiver 13 through a line 9 with an shut-off valve 9*a*, and the upper part of the heat exchanger vessel 2 is connected to a water filter 7 by an air discharge line 8 with a discharge valve 8*a*, and the water filter is open to the atmosphere. The lower part of the first part 1*a* is connected to the lower part of the refrigerant receiver 13 by a return pipeline 10. Hereby, the mixture of air, the noncondensable gas, if any, and refrigerant passes from the refrigerant receiver to the air separator part in which the air is separated, resulting from the cooling from the secondary heat exchanger 4 and the cooling through the heat transmitting wall between the two container parts 1*a*, 2. The refrigerant is collected at the bottom of the vessel part 2 and is conducted back to the refrigerant receiver, while the air and noncondensable gas rises and is discharged into the atmosphere.

Figure 4:
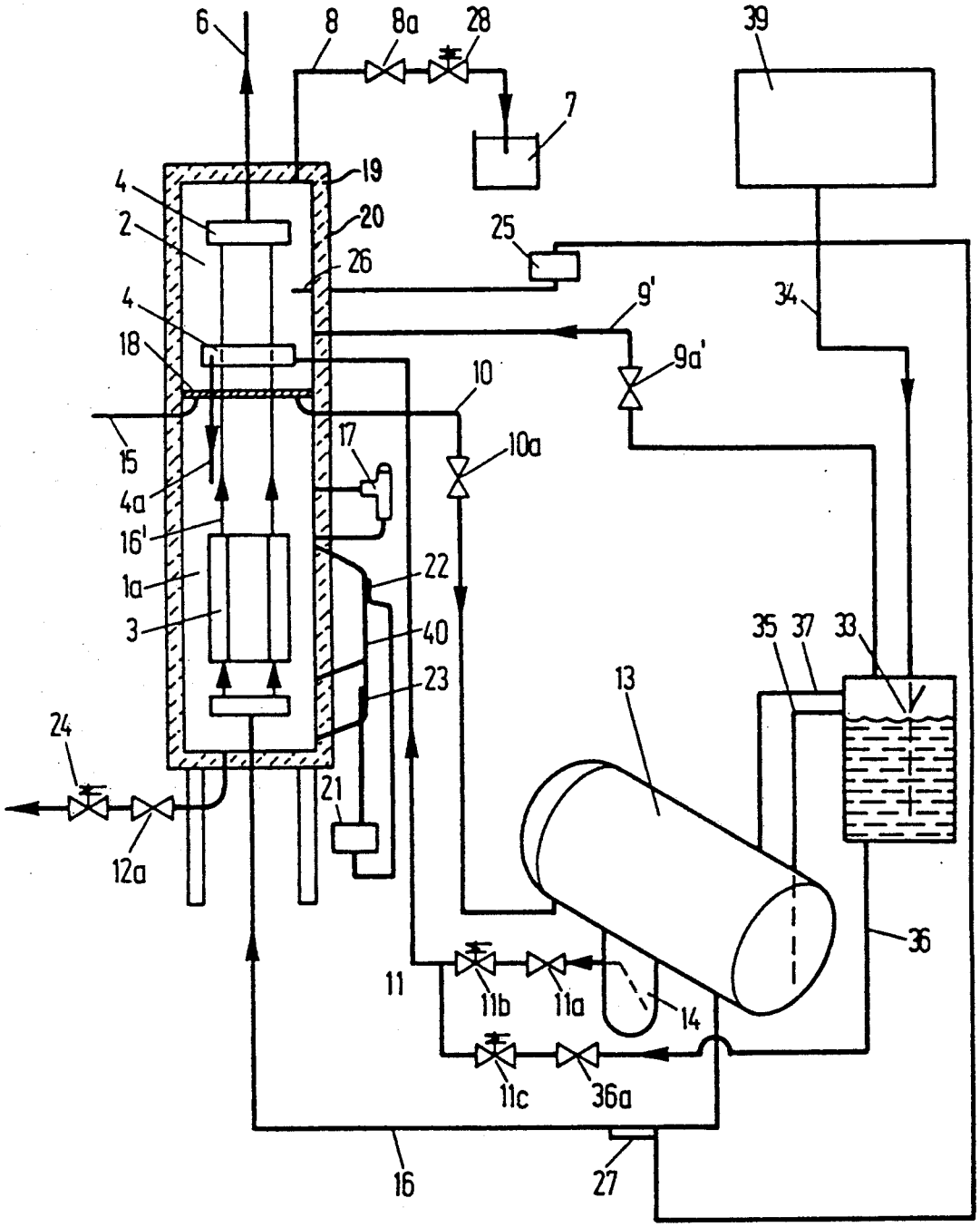
FIG. 4 shows schematically an embodiment of the refrigerating system according to the invention with an oil separator, with several steps, and with a combined separator for oil and air with equipment for automatic separation of oil and air and noncondensable gas.

The embodiment of the refrigerating system according to the invention shown schematically in FIG. 4 is a combination of the embodiments shown in FIGS. 2 and 3, as the oil separation takes place in two steps, and the heat exchanger vessel is divided in two parts 1*a*, 2 so that both the oil and the air and noncondensable gas may be separated. The second part of the heat exchanger vessel 2 is connected to the upper part of the primary vessel 33 by a line 9' with an inserted shut-off valve 9*a*', instead of being connected to the upper part of the refrigerant receiver 13 as illustrated in FIG. 3, the refrigerant receiver 13 is connected to the upper part of the primary vessel 33 by the connecting line 37. Thereby, the mixture of air and refrigerant is conducted from the refrigerant receiver 13 to the primary vessel 33 and with a mixture of air and refrigerant which is collected in the primary vessel is conducted to the air separator, which functions as explained above.

This embodiment is furthermore arranged such that the separation both of oil and of air and noncondensable gas takes place automatically. The automatic oil separation is obtained by providing the first part 1*a* of the heat exchanger vessel with an uninsulated steel standpipe 40 for the indication of the level of the liquid in the vessel a differential thermostat 21 with two detectors 22, 23 is mounted on the standpipe such that the variation of the oil level which produces a perceptible difference in temperature of the liquid in the standpipe, may control the opening and the closing of a magnet valve 24 in the oil discharge pipe 12.

The automatic separation of air and noncondensable gas is achieved by providing the second part 2 of the heat exchanger vessel with a differential thermostat 25 which has first detector 26 mounted in the second part 2 of the heat exchanger vessel, while a second detector 27 of the differential thermostat is mounted in the primary pipe connection 16 between the refrigerant receiver 13 and the primary heat exchanger 3. The differential thermostat is controlled through a relay by a third magnet valve 28 which is mounted in the air discharge pipe 8, such that the valve opens when the air or noncondensable gas acts upon the first detector 26 and closes again, by the warmer refrigerant in the primary pipe connection 16 acting upon the second detector 27 when the space has been ventilated.

By the embodiments shown in FIGS. 3 and 4, it is possible, when the system is sufficiently ventilated, to operate only the oil separator by closing the shut-off valves 9*a*, 10*a* in respectively in the pipe 9 between the primary vessel 33 and the second part 2 of the heat exchanger vessel and the pipe 10 between the vessel and the refrigerant receiver 13. Hereby, a more economical operation of the system is achieved as the cooling, which is produced by the evaporators of the refrigerant, will be employed fully for cooling the refrigerant which flows towards the evaporators of the system through the primary heat exchanger.

I claim:

1. A compression refrigerating system comprising:

a condenser;

a refrigerant receiver for receiving refrigerant and having an oil sump;

a primary pipe for conducting the refrigerant;

an oil sump pipe for conducting the refrigerant;

a suction pipe for conducting the refrigerant;

an oil discharge pipe having an oil discharge valve;

evaporators having a supply pipe;

a motor;

a compressor driven by the motor for compressing the refrigerant;

a condenser for cooling the refrigerant and collected in the refrigerant receiver, the refrigerant being conducted to the evaporators spaced in portions of the system to be cooled;

an oil separator including a heat exchanger vessel for separating oil from the refrigerant, said heat exchanger vessel including a primary heat exchanger having a supply side connected to an outlet of the refrigerant receiver through the primary pipe and having a discharge side connected to the supply pipe of the evaporators, the heat exchanger vessel being connected to the oil sump through the oil sump pipe, the oil sump being in an bottom part of the refrigerant receiver, the heat exchanger vessel being connected to a suction side of the compressor through the suction pipe, and wherein a lower part of the heat exchanger vessel is provided with the oil discharge pipe.

2. A compression refrigerating system according to claim 1, wherein the oil separator further comprises a primary vessel for the separation of the oil and the refrigerant, a supply line for supplying liquid refrigerant to the primary vessel from the condenser, a discharge line for conducting the refrigerant, a primary oil discharge line conducting the refrigerant and having a shut-off valve, the primary vessel being connected to an outlet of the condenser through the supply line, the primary vessel being connected to the refrigerant receiver through the primary oil discharge line, the primary vessel being connected to the oil sump pipe, and wherein oil separation occurs within the heat exchanger vessel.

3. A compression refrigerating system according to claim 1, wherein the heat exchanger vessel further includes a first vessel portion, a second vessel portion for separating air and non-condensable, gas a heat transmitting wall separating the first vessel portion and the second vessel portion, said first vessel portion including said primary heat exchanger for separating the oil, said second vessel portion including a secondary heat exchanger, said compression refrigerating system further comprises a line, an air discharge line, a downpipe, and a return pipe, wherein one side of the secondary heat exchanger si connected to the primary heat exchanger for conducting the refrigerant to the evaporators of the system, another side of the secondary heat exchanger is connected to the oil sump of the refrigerant receiver through the oil sump pipe, the secondary heat exchanger si connected to the first vessel portion of the heat exchanger container through the downpipe so that the liquid mixture of oil and refrigerant flows from the oil sump through the secondary heat exchanger to the first vessel portion through the downpipe, wherein the second vessel portion of the heat exchanger vessel is connected to an upper part of the refrigerant receiver through the line, the second vessel portion of the heat exchanger is connected to the atmosphere through the air discharge line, and wherein the second portion of the heat exchanger is connected to the refrigerant receiver through the return pipeline.

4. A compression refrigerating system according to claim 3, wherein said compression refrigerating supply system further comprises a primary vessel, a discharge line, a supply line, and a primary discharge line, the primary vessel being connected to an outlet of the condenser through the supply line for conducting the liquid refrigerant from the condenser, the primary vessel being connected to the refrigerant receiver through the discharge line, the primary vessel being connected to the oil sump pipe through the primary discharge line, and wherein oil separation occurs in the heat exchanger container of the oil separator.

5. A compression refrigerating system according to claim 4, further comprising a second line, wherein the primary vessel of the oil separator is spaced above the refrigerant receiver, an end of the supply line is passed through spaced within a lower portion of the primary vessel, an upper portion of the primary vessel is connected to a lower portion of the refrigerant receiver through the discharge line, the upper portion of the primary vessel is connected to the refrigerant receiver through the second line for the separation of air and noncondensable gas, the second vessel portion of the heat exchanger vessel being connected to the upper portion of the primary vessel through the line and wherein, said line includes an valve.

6. A compression refrigerating system according to one of claims 1, 2, 3 or 4, wherein the heat exchanger vessel is insulated with a heat insulating material.

7. A compression refrigerating system according to one of claim 1, 2, 3 or 4, wherein the heat exchanger vessel includes an uninsulated standpipe for an indication of the level of the liquid in the heat exchange vessel.

8. A compression refrigerating system according to one of claim 1 or 3, wherein the heat exchanger vessel of the oil separator includes an electric level regulator, a relay, a magnet valve in the oil sump pipe, wherein the electric level regulator activates the relay to control the magnetic valve in order to maintain a predetermined liquid level in the heat exchanger vessel.

9. A compression refrigerating system according to one of claim 1 or 3, wherein the heat exchanger vessel of the oil separator includes a float valve to maintain a predetermined liquid level in the heat exchanger vessel.

10. A compression refrigerating system according to one of claim 2 or 4, wherein the heat exchanger vessel of the oil separator includes an electronic level regulator, a relay, a timer and two magnetic valves, respectively, in the oil sump pipe and in the oil discharge pipe connected to the primary vessel, and wherein a predetermined liquid level in the heat exchanger vessel is maintained by a mixture of oil and refrigerant alternately supplied from the primary container of the oil separator or from the oil sump of the refrigerant receiver.

11. A compression refrigerating system according to one of claims 1, 2, 3 or 4, wherein the heat exchanger vessel of the oil separator includes a standpipe for providing an indication of an oil level in the heat exchanger vessel, a relay, a magnetic valve and a differential thermostat including a first detector and a second detector mounted on the standpipe such that the differential thermostat, in accordance with variations in the oil level in the standpipe, activates the relay to control the opening and closing of the magnetic valve in the oil discharge pipe.

12. A compression refrigerating system according to one of claims 3, 4 or 5, wherein the second part of the heat exchanger container of the oil separator includes a relay, a differential thermostat, a magnetic valve having a first detector spaced inside the heat exchanger vessel at a predetermined level, and a second detector mounted in the primary pipe between the refrigerant receiver and the primary heat exchanger, wherein the differential thermostat activates the relay to control the opening and closing of the magnetic valve mounted in the air discharge pipe.

13. A compression refrigerating system comprising:

a compressor for compressing a refrigerant;

a motor for driving said compressor;

a condenser for cooling the compressed refrigerant;

a collector vessel for collecting condensed refrigerant and including an oil sump;

an evaporator adapted to be cooled by the condensed refrigerant;

an oil separator having a primary heat exchanger in a heat exchanger vessel;

means for supplying refrigerant from the collector vessel to the evaporator through the primary heat exchanger;

means for supplying the oil-refrigerant mixture from the oil sump to the heat exchanger vessel and releasing refrigerant to the compressor through a suction pipe; and an oil discharge pipe including a valve arranged in a lower part of the heat exchanger vessel.

14. A compression refrigerating system comprising:

a compressor for compressing a refrigerant;

a motor for driving the compressor;

a condenser for condensing the compressed refrigerant;

a collector for collecting condensed refrigerant and including an oil sump;

an evaporator adapted to be cooled by the condensed refrigerant;

an oil separator having a primary heat exchanger in a heat exchanger vessel, heat exchanger receiving refrigerant from the collector through a primary pipe and supplying the evaporator through a supply pipe;

wherein the heat exchanger vessel receives a mixture of oil and refrigerant from the sump through a sump pipe and releases refrigerant to the compressor through a suction pipe; and an oil discharge pipe is provided at a lower part of the heat exchanger vessel, with the oil discharge pipe including an oil discharge valve.

15. A compression refrigerating system according to claim 14, wherein the oil separator further comprises a primary vessel connected between the condenser and the collector and connected by an oil discharge pipe though a valve to the sump pipe.

16. A system according to claim 14, wherein the heat exchanger vessel comprises:

a first part which contains the primary heat exchanger and separates oil form the refrigerant, and a second part, above the first part, which contains a secondary heat exchanger and separates air and noncondensable gases from the refrigerant, the refrigerant from the primary heat exchanger passes through the secondary heat exchanger before being supplied to the evaporator, oil from the sump is passed through the secondary heat exchanger to the first part of the vessel, and wherein the second part of the vessel receives refrigerant and gases from the upper part of the collector and returns substantially on the refrigerant to the lower part of the collector, and, in the upper part, is provided with an air discharge pipe and air discharge valve.

17. A system according to claim 16, wherein the first part of the heat exchanger vessel includes a standpipe for indicating an oil level and a differential thermostat mounted on the standpipe for controlling a magnetic valve in the oil discharge pipe.

18. A system according to claim 16, wherein the second part of the heat exchanger vessel has a differential thermostat including a first detector inside the second part of the heat exchanger vessel and a second detector in the primary pipe for controlling the air discharge valve in the air discharge pipe, with said air discharge valve being fashioned as a magnetic valve.

* * * * *